US011004592B2

(12) United States Patent
Bellur et al.

(10) Patent No.: US 11,004,592 B2
(45) Date of Patent: May 11, 2021

(54) HIGH-CURRENT HALF-TURN WINDINGS

(71) Applicant: Cummins Power Generation IP, Inc., Minneapolis, MN (US)

(72) Inventors: Subbarao Dakshina Murthy Bellur, Minneapolis, MN (US); Kartik Iyer, Minneapolis, MN (US); Minyu Cai, West Lafayette, IN (US)

(73) Assignee: Cummins Power Generation IP, Inc., Minneapolis, MN (US)

( * ) Notice: Subject to any disclaimer, the term of this patent is extended or adjusted under 35 U.S.C. 154(b) by 313 days.

(21) Appl. No.: 15/828,024

(22) Filed: Nov. 30, 2017

(65) Prior Publication Data

US 2018/0158594 A1 Jun. 7, 2018

Related U.S. Application Data

(60) Provisional application No. 62/428,934, filed on Dec. 1, 2016.

(51) Int. Cl.
*H01F 27/29* (2006.01)
*H01F 27/28* (2006.01)
(Continued)

(52) U.S. Cl.
CPC ..... *H01F 27/2823* (2013.01); *H01F 27/24* (2013.01); *H01F 27/29* (2013.01);
(Continued)

(58) Field of Classification Search
CPC .. H01F 30/10; H01F 2027/065; H01F 17/003; H01F 27/29; H01F 2027/2814; H01F 27/24
(Continued)

(56) References Cited

U.S. PATENT DOCUMENTS 2,283,711 A 5/1942 Welch, Jr.
2,855,576 A * 10/1958 Rohatyn ..... H01F 30/12 336/182
(Continued)

OTHER PUBLICATIONS

"Leakage Inductance," Wikipedia article, Aug. 8, 2016, 6 pages; https://en.wikipedia.org/wiki/Leakage_inductance.
(Continued)

*Primary Examiner* — Elvin G Enad
*Assistant Examiner* — Joselito Baisa
(74) *Attorney, Agent, or Firm* — Foley & Lardner LLP

(57) ABSTRACT

An electric device comprises a core having a center section and two outer sections, a high current winding, and a low current winding. The high current winding includes a plurality of half-turn coils connected in parallel between a first high current terminal and a second high current terminal. Each of the plurality of half-turn coils is wound around a fraction of the center section and forms a loop around one of the two outer sections along with the first and second high current terminals. The low current winding includes a plurality of full-turn coils connected in series between a first low current terminal and a second low current terminal, each of the plurality of full-turn coils wound around the center section of the core substantially fully. The plurality of half-turn coils of the high current winding are interleaved with the plurality of full-turn coils of the low current winding.

18 Claims, 4 Drawing Sheets

(51) Int. Cl.
*H01F 27/24* (2006.01)
*H01F 30/06* (2006.01)
*H01F 27/30* (2006.01)
*H01F 38/00* (2006.01)

(52) U.S. Cl.
CPC ..... *H01F 27/306* (2013.01); *H01F 30/06* (2013.01); *H01F 38/00* (2013.01); *H01F 27/2852* (2013.01)

(58) Field of Classification Search
USPC ..... 336/192
See application file for complete search history.

(56) References Cited

U.S. PATENT DOCUMENTS 3,132,318 A 5/1964 Kiltie
3,602,023 A * 8/1971 Furth ..... H01F 7/202 72/56
3,638,156 A * 1/1972 West ..... H01F 5/003 336/200
3,768,055 A 10/1973 Oliver
5,331,536 A * 7/1994 Lane ..... H01F 27/2847 336/178
5,367,760 A 11/1994 Terlop et al.
5,999,079 A 12/1999 Wille
6,087,922 A 7/2000 Smith
6,137,392 A 10/2000 Herbert
6,160,467 A 12/2000 Teimorzadeh et al.
6,239,683 B1 * 5/2001 Roessler ..... H01F 27/2804 336/200
6,307,458 B1 * 10/2001 Zhang ..... H01F 17/0006 336/200
6,348,848 B1 2/2002 Herbert
7,248,139 B1 * 7/2007 Podlisk ..... H01F 27/2847 336/232
7,332,993 B1 2/2008 Nussbaum
7,425,884 B2 * 9/2008 Suzui ..... H01F 41/063 336/200
7,489,226 B1 * 2/2009 Chignola ..... H01F 27/2804 336/229
7,889,047 B2 * 2/2011 Yang ..... H01F 27/2895 336/229
8,013,708 B2 * 9/2011 Tsai ..... H01F 27/2804 336/200
8,299,886 B2 * 10/2012 Won ..... H01F 27/22 336/221
8,766,759 B2 * 7/2014 Shih ..... H01F 27/40 336/220
8,912,875 B1 * 12/2014 Tsai ..... H01F 27/2866 336/206
9,159,484 B2 * 10/2015 Tiemeijer ..... H01F 27/2804
9,431,473 B2 * 8/2016 Lo ..... H01F 21/00
9,934,904 B2 * 4/2018 Hunter ..... H02K 35/04
2011/0148563 A1 * 6/2011 Tsai ..... H01F 27/2804 336/200
2012/0098509 A1 * 4/2012 de Rochemont ... H01F 27/2804 323/282
2017/0012601 A1 * 1/2017 Yen ..... H03H 7/42

OTHER PUBLICATIONS

"Power electronics," Wikipedia Article, Aug. 8, 2016, 17 pages; https://en.wikipedia.org/wiki/Power_electronics.
"Switched-Mode Power Supply," Wikipedia Article, Aug. 8, 2016 16 pages; https://en.wikipedia.org/wiki/Switched-mode_power_supply.
Ouyang, Ziwei et al., "The Analysis Comparison of Leakage Inductance in Different Winding Arrangements for Planar Transformer," International Conference on Power Electronics and Drive Systems, 2009. PEDS 2009. IEEE, 2009. p. 1143-1148.
International Search Report and Written Opinion for International Application No. PCT/US2017/064001, dated Mar. 9, 2018, 15 pages.

* cited by examiner

HIGH-CURRENT HALF-TURN WINDINGS

CROSS-REFERENCE TO RELATED APPLICATIONS

This application claims priority to and the benefit of U.S. Provisional Patent Application No. 62/428,934, entitled "High-Current Half-Turn Windings," filed Dec. 1, 2016, which is incorporated herein by reference in its entirety.

TECHNICAL FIELD

The present disclosure relates generally to transformers and inductors. More particularly, the present disclosure relates to windings of transformers and inductors.

BACKGROUND

Transformers are often used in high efficiency electric and power electronics applications, such as direct current to direct current (DC-DC) converters, direct current to alternating current (DC-AC) inverters, and alternating current to alternating current (AC-AC) systems. In some applications, high turns ratio, low total leakage inductance, and very high current ratings on the low voltage winding are desired for the transformer. Typically, high current low voltage windings are connected in parallel, while the low current high voltage windings are in series to achieve a high turns ratio. In addition, the low leakage inductance can be achieved by interleaving the low voltage and high voltage windings. This arrangement requires multiple terminations of both low voltage and high voltage windings, which might cause difficulty in manufacturability, increase leakage inductance, and consume more space.

Electric power transformers have a wide variety of applications. High-switching-frequency (e.g., 600 Hz, 1,200 Hz, 100,000 Hz, etc.) transformers are often used in modern compact high efficiency power electronics applications, such as DC-DC converters or DC-AC inverters. The high-frequency switching can help avoid saturation of inductors and transformers, enabling use of magnetic elements that have less weight and lower material cost. Furthermore, the high-frequency switching enables the use of optimal low loss operation switching in power electronics, such as bipolar junction transistors (BJT), metal-oxide-semiconductor field-effect transistors (MOSFET), etc., which may have differing switching speeds and/or control schemes.

SUMMARY

One aspect of the disclosure relates to an electric device. The electric device comprises a core, a high current winding, and a low current winding. The core comprises a center section and two outer sections. The high current winding includes a plurality of half-turn coils connected in parallel between a first high current terminal and a second high current terminal, each of the plurality of half-turn coils wound around a fraction of the center section of the core. Each of the plurality of half-turn coils forms a loop around one of the two outer sections along with the first terminal and the second terminal. The low current winding includes a plurality of full-turn coils connected in series between a first low current terminal and a second low current terminal, each of the plurality of full-turn coils wound around the center section of the core substantially fully. The plurality of half-turn coils of the high current winding are interleaved with the plurality of full-turn coils of the low current winding. The plurality of half-turn coils and the plurality of full-turn coils can be constructed from foil winding, solid wire, stranded wire, or Litz wire.

Another aspect of the disclosure relates to an electric device. The electric device comprises a core and a winding. The core comprises a center section and two outer sections. The winding includes a plurality of half-turn coils connected in parallel between a first terminal and a second terminal, each of the plurality of half-turn coils wound around a fraction of the center section of the core. Each of the plurality of half-turn coils forms a loop around one of the two outer sections along with the first terminal and the second terminal.

These and other features, together with the organization and manner of operation thereof, will become apparent from the following detailed description when taken in conjunction with the accompanying drawings.

DETAILED DESCRIPTION

Figure 2:
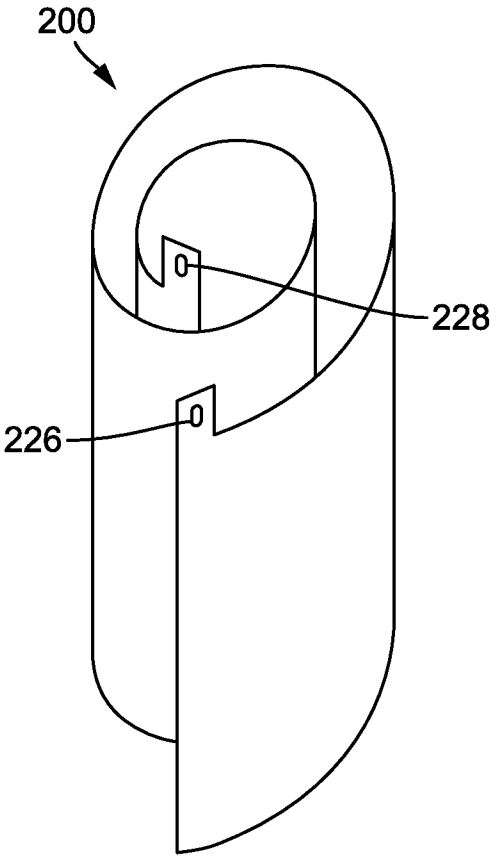
FIG. 2 is a schematic diagram of a low-current full-turn winding with terminals according to an exemplary embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

A transformer includes a primary winding and a secondary winding that are electromagnetically coupled. In particular, the primary winding and the secondary winding can be wrapped around a transformer core of high magnetic permeability (e.g., a magnetic or ferrous core) so that the magnetic flux passes through both the primary and secondary windings. A varying current (e.g., an alternating current) applied to the primary winding creates a varying magnetic flux in the transformer core and a varying magnetic field impinging on the secondary winding. The varying magnetic field at the secondary winding induces a varying voltage in the secondary winding due to electromagnetic induction. Thus, the transformer can transfer electrical energy between a voltage source connected to the primary winding and a load impedance connected to the secondary winding. Inductors are similar, but generally only have a single winding electromagnetically coupled to itself wound around air or a core and does not interact with any other winding.

An electric power transformer is used in a DC-DC converter or DC-AC inverter or AC-AC system for stepping up or stepping down a voltage in electric power applications. The ratio of the primary voltage (i.e., voltage on the primary winding) to the secondary voltage (i.e., voltage on the secondary winding) is proportional to the ratio of primary winding turns to the secondary winding turns, according to Faraday's law of induction. As used herein, winding turns refer to the number of physical turns between two terminals of the winding around the transformer core. If the ratio of primary winding turns to the secondary winding turns is greater than one (1), the application is a step-down application. If the ratio of primary winding turns to the secondary winding turns is smaller than one (1), the application is a step-up application. Furthermore, the ratio of the primary current (i.e., current flowing through the primary winding) to the secondary current (i.e., current flowing through the secondary winding) is inversely proportional to the ratio of winding turns and the voltage ratio, according to the law of Conservation of Energy. Thus, the winding with fewer turns which has a higher current flowing therethrough is referred to as the "high current" winding; the winding with more turns which has a lower current flowing therethrough is referred to as the "low current" winding.

High-switching-frequency (e.g., 600 Hz, 1,200 Hz, 100,000 Hz, etc.) transformers are often used in modern compact high efficiency power electronics applications because they enable use of magnetic elements of less weight and lower material cost and the use of optimal low loss operation switching in power electronics. However, high-switching-frequency transformers and inductors may have issues not encountered in low-switching-frequency (e.g., 50 Hz, 60 Hz, etc.) applications, such as skin effect, leakage inductance, and parasitic capacitance. Skin effect refers to the tendency of alternating current to flow near the surface of a conductor. The depth to which the current penetrates depends on the frequency of the current—the higher the frequency, the less depth is penetrated. Skin effect may significantly reduce the current carrying capacity of a wire by reducing the bulk conduction through the cross sectional area of the wire. Additional wire thickness does not add lot to current carrying capacity as surface area is not increased at the same rate as cross sectional area.

Leakage inductance derives from the electrical property of an imperfectly-coupled transformer whereby each winding behaves as a self-inductance in series with that winding's resistance. Leakage flux alternately stores and discharges magnetic energy with each electrical cycle acting as an inductor in series with each of the primary and secondary windings. Leakage inductance depends on the geometry of the core and the windings. Leakage inductance may cause power loss and/or inferior voltage regulation in the transformer. In modern power electronics applications, the leakage inductance is used as an energy transfer element for high efficiency power conversion. In some embodiments, the leakage inductance has a specific value for the converter operation. In further embodiments, the specific value of leakage inductance may be low and cannot be achieved by conventional winding approaches.

Parasitic capacitance is a capacitance that exists between the primary winding and the secondary winding caused by the proximity of the primary winding and the secondary winding. In high frequency applications, parasitic capacitance may cause the inverter/converter circuit to oscillate or otherwise couple with the transformer inductance and thus affect the operation of the inverter/converter circuit.

Referring to the figures generally, various embodiments disclosed herein relate to interleaved half-turn high-current windings that can be used for a transformer and/or an inductor. In particular, according to some exemplary embodiments, a transformer core has a center section that carries the total magnetic flux and two outer sections each carrying half of the total magnetic flux. The high current winding includes a plurality of half-turn coils connected in parallel between two terminals of the high current side winding. Each half-turn coil extends around a fraction of the center section of the transformer core, and forms a loop around one of the two outer sections of the core along with the two terminals of the high current side winding. The low current winding includes a plurality of full turns of coils connected in series between two terminals of the low current side winding. Each of the plurality of full turns of coils extends around the full center section of the core. The high current side winding and the low current side winding are interleaved with each other. The half-turn coils and full-turn coils may be constructed from a foil conductor winding, solid wire, stranded wire, or Litz wire. With the half-turn winding, the total number of turns in both windings can be reduced; therefore the leakage inductance and the parasitic capacitance can be reduced accordingly. In addition, because fewer turns of windings are used, transformer size, weight, and cost can be lowered.

Figure 1:
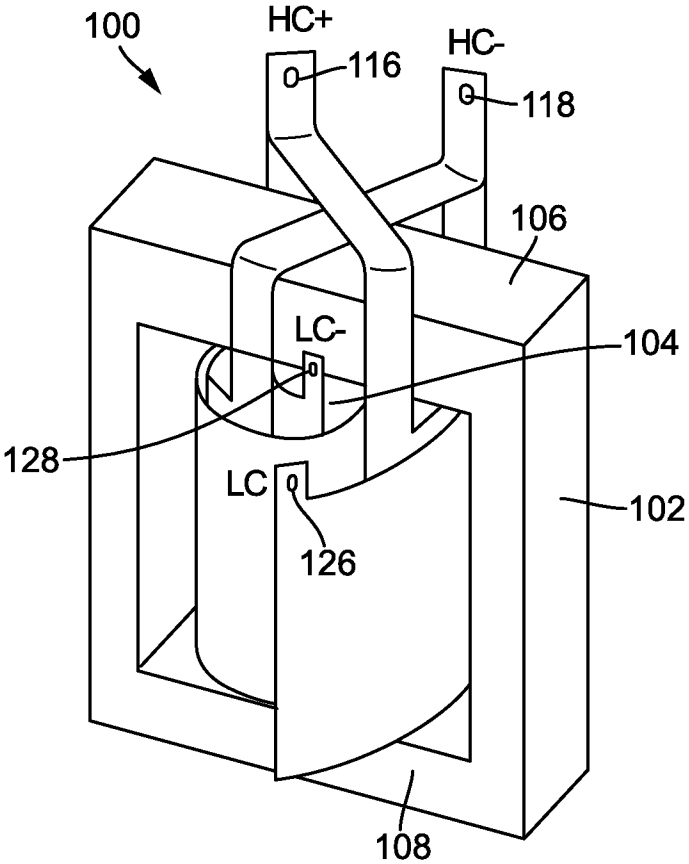
FIG. 1 is a schematic diagram of an electric device with interleaved high-current and low-current windings according to an exemplary embodiment.

Referring to FIG. 1, a schematic diagram of an electric device 100 with interleaved high-current winding and low-current winding is shown according to an exemplary embodiment. The electric device 100 can be a transformer, which includes a core 102, a high current winding between two terminals 116 and 118, and a low current winding between two terminals 126 and 128. The core 102 allows magnetic flux to flow through. In some embodiments, the core 102 may be a magnetizable core with high magnetic permeability, such as a rod or bar of ferrite, samarium cobalt, or neodymium-iron-boron. In some embodiments, the core 102 may be a core of low permeability for high-frequency applications. The core 102 includes a center section 104 and two outer sections 106 and 108. The center section 104 carries the total magnetic flux flowing through. The two outer sections 106 and 108 each carry half of the total magnetic flux. The core 102 can be various types, such as EE, EI, EFD, ETD, EP, P, RM, etc.

Referring to FIG. 2, a perspective view of a low-current full-turn winding 200 of a foil conductor winding type with a first low current terminal 226 and a second low current terminal 228 is shown according to an exemplary embodiment. It is noted that other wire types, such as, but not limited to solid wire, stranded wire, or Litz wire are also possible. Generally speaking, the more surface area present in a conductor type, the high the frequency can be used with the transformer design due to the conductor's improved ability to tolerate and carry skin effect conduction. The low-current full-turn winding 200 may correspond to the low-current winding of FIG. 1. The low current winding 200 includes a plurality of full-turn coils connected in series between the first and second terminals 226 and 228. Each of the full-turn coils is wound around the center section 104 of the core 102 substantially fully. The coils may be stacked one atop the other on the center section 104, or may be wrapped one after the other continuously on the center section 104. Because the full-turn coils are connected in series, the number of winding turns for the low-current winding 200 is the total number of the full-turn coils. The low current winding 200 shown in FIG. 2 is circular, but it shall be understood that the low current winding can be rectangular, helical, or any other suitable shape. The first and second low current terminals 226 and 228 can electrically connect the low current winding to various circuits (e.g., a voltage source or a load). If the low current winding 200 is made of a series of serially connected sub-windings or coils, these sub-windings will be coupled together via terminals or other connection types at their ends to form the overall low current winding 200. The terminals of the sub-windings or coils of the low current winding 200 can be brought out of the winding structure to be externally available, similar to the first and second terminals 226 and 228, or, advantageously, kept internal to the transformer winding structure so as to not interfere with other terminal connections to the transformer.

Figure 3B:
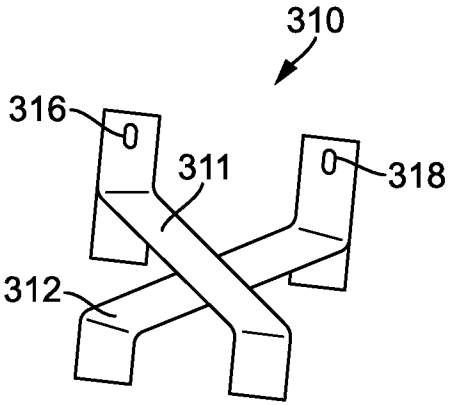
FIG. 3B is a schematic diagram of the cross connections for the high-current half-turn winding according to an exemplary embodiment.
Figure 3A:
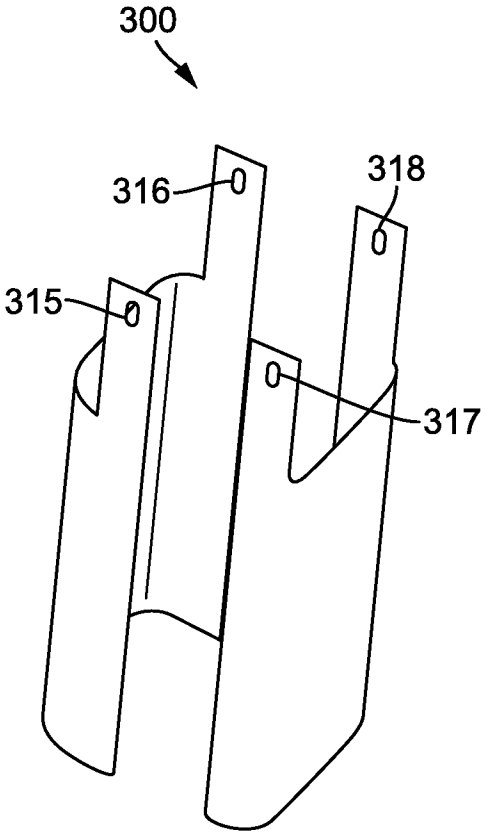
FIG. 3A is a schematic diagram of a high-current half-turn winding with terminals according to an exemplary embodiment.

Referring to FIG. 3, a high-current half-turn winding of a foil conductor type is shown according to an exemplary embodiment. FIG. 3A shows the high-current half-turn winding 300 with terminals 315, 316, 317, and 318. FIG. 3B shows the cross connections 310 for the high-current half-turn winding 300. The high-current half-turn winding 300 may correspond to the high-current half-turn winding of FIG. 1. The high current winding 300 includes a plurality of half-turn coils connected in parallel between the high current terminals 315 and 316 and a plurality of half-turn coils connected in parallel between the high current terminals 317 and 318. Each of the half-turn coils is wound around a fraction of the center section 104 of the core 102. The coils may be stacked one atop the other on the center section 104, or may be wrapped one by one on the center section 104. The high current winding shown in FIG. 3A is half of a circle, but it shall be understood that the high current winding can be half of a rectangle, a hexagon, or any other suitable shape. It is noted that high-current half-turn winding embodiments of the present invention utilizing other wire types, such as, but not limited to solid wire, stranded wire, or Litz wire are also possible.

Cross connections 310 are formed that connect the terminals 316 and 317 together and the terminals 315 and 318 together. As shown in FIG. 3A, a plurality of half-turn coils are connected in parallel between the high current terminals 315 and 316, and a plurality of half-turn coils are connected in parallel between the high current terminals 317 and 318. For these coils to work appropriately, cross connections 310 are used to connect the coils between terminals 315 and 316 and the coils between terminals 317 and 318 so that magnetic flux in these coils adds together rather than cancel out. The cross connections 310 include a first connection 311 and a second connection 312 each crossing the outer section 106 of the core 102, and electrically insulated from each other. The first connection 311 electrically connects the terminal 316 to the terminal 317. The second connection 312 electrically connects the terminal 315 to the terminal 318. Thus, only the two terminals 316 are 318 would be used for connection to external circuits/devices. The first high current terminal 316 and the second high current terminal 318 can electrically connect the high current winding to various circuits (e.g., a voltage source or a load). Each of the half-turn coils forms a loop around the outer section 106 with the terminals 316 and 318. Through the cross connections 311 and 312, magnetic flux in half-turn coils between terminals 315 and 316 and magnetic flux in half-turn coils between terminals 317 and 318 adds together. Because the half-turn coils are connected in parallel and the outer section 106 carries half of the magnetic flux flowing through the core 102, the number of turns for the high-current winding 300 is half (½). It is noted that in some embodiments, the cross connections 312, 311 can be incorporated into the terminals 315, 317, respectively, of the half turn coils and not be a separate item.

The high current winding and the low current winding may be arranged in an interleaved manner to achieve low leakage inductance. As discussed above, the low current winding includes a plurality of full-turn coils connected in series between the first low current terminal 126 and the second low current terminal 128. Each of the full-turn coils is wound around the center section 104 of the core 102 substantially fully. In some embodiments, the first low current terminal 126 is disposed at the outermost full-turn coil, and the second low current terminal 128 at the innermost full-turn coil, as shown in FIG. 1. Since the half-turn coils of the high current winding provide openings for the continuous wrapping of the low current winding, no special terminations are required for series connections of the full-turn coils. In other words, the openings allows a single continuous winding without external terminations for series connections in this arrangement. Thus, the low-current or high-current windings can be reconfigured to different turns ratios. For example, a transformer can be easily reconfigured by altering its terminations to differing winding ratios and use of serial or parallel coil connection arrangements, in particular, of the low current half-coil windings. In addition, because the number of winding turns on the high current side is half (½), the number of turns in both windings are reduced by half comparing to the design implemented with windings using full coil turn(s) on the high current side. Therefore, winding material, transformer size, and cost can be reduced accordingly. For example, the current output of a half-turn transformer design can be kept the same as a full-turn transformer due to the parallel connection of the two sets of half-turn windings and the same amount of magnetic flux being captured. Conductor material costs and size can also be reduced due to the fact that each half-turn coil will be carrying half (½) the current present in a full-turn coil implementation (which is then combined via the parallel coupling). In addition, the leakage inductance and parasitic capacitance, related to the transformer size, design, and number of turns, can also be reduced due to fewer secondary turns and fewer interleaving layers. The DC resistance of the half-turn transformer high current winding is also reduced in this arrangement due to parallel connection of the inherent coil resistances (if conductor size is kept the same), while the reduced number of total turns will also reduce the DC resistance and overall material costs of the full-turn low current winding.

Figure 4:
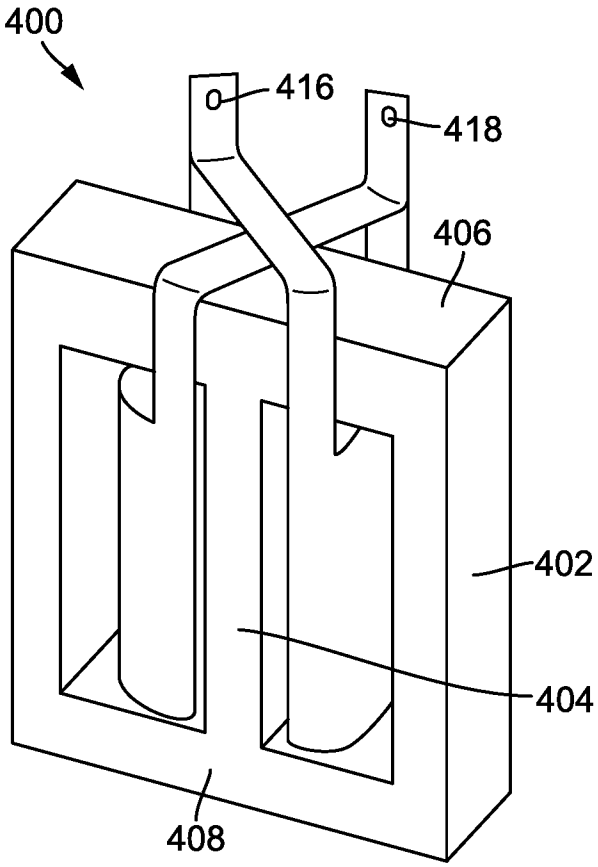
FIG. 4 is a schematic diagram of the electric device with only the high-current half-turn winding according to an exemplary embodiment.

Referring to FIG. 4, a schematic diagram of an electric device 400 with high-current half-turn winding only is shown according to an exemplary embodiment. The electric device 400 can be an inductor, which includes a core 402, a high current winding between a first terminal 416 and a second terminal 418. The core 402 may be similar to the core 102 of FIG. 1. The core 402 includes a center section 404 and two outer sections 406 and 408. The center section 404 carries the total magnetic flux flowing through. The two outer sections 406 and 408 each carry half of the total magnetic flux. The half-turn winding may be similar to the winding 300 shown in FIGS. 3A and 3B. Each of the half-turn coils forms a loop around the outer section 406 with the first and second terminals 416 and 418.

Half-turn winding design approach also adds more flexibility to inductor design. Usually, a small inductance can be generated by using a small core, large air-gap length or material with small permeability. However, the standard core size, air-gap length and material permeability are discrete, difficult to change design consideration. Sometimes, a small core cannot be used due to high power level of the inductor, while making customized air-gap length and material permeability is expensive. Since half-turn winding can reduce the inductance of a one-turn inductor to ¼ of its full turn value, it may be used to achieve the desired inductance using standard core size, air-gap length and material permeability. In addition, the current rating of a half-turn inductor transformer design can be kept the same as a one-turn inductor due to the parallel connection of the two sets of half-turn windings. The DC resistance of the winding is also reduced in this arrangement due to parallel connection of the inherent coil resistances (if conductor size kept the same). Conductor material costs and size can also be reduced due to the fact that each half-turn coil will be carrying half (½) the current present in a full-turn coil implementation.

Figure 5B:
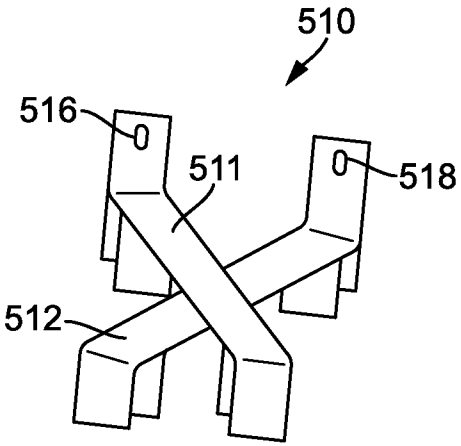
FIG. 5B is a schematic diagram of the cross connections for the two layers of high-current half-turn windings according to an exemplary embodiment.
Figure 5A:
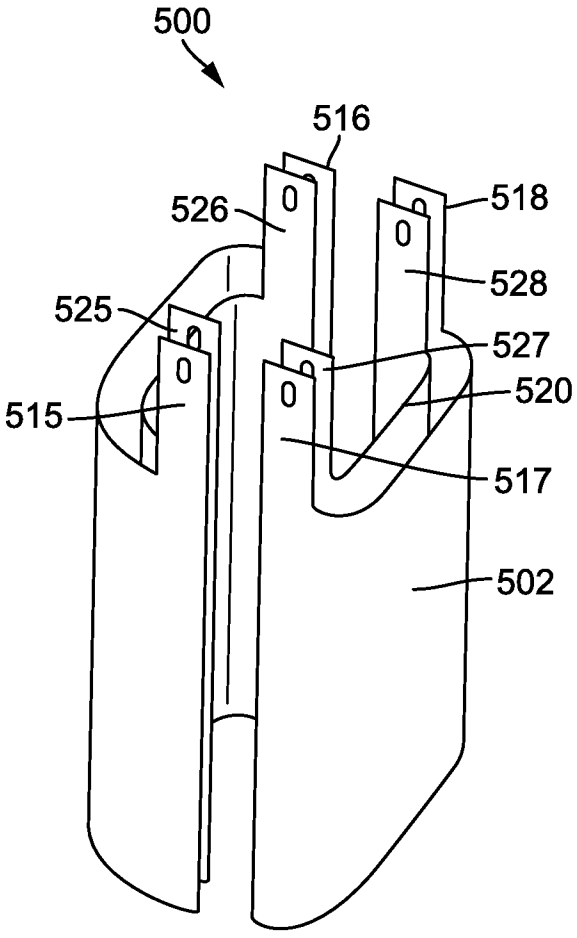
FIG. 5A is a schematic diagram of two layers of high-current half-turn windings with terminals according to an exemplary embodiment.

Referring to FIG. 5, a two-layer high-current half-turn winding is shown according to an exemplary embodiment. FIG. 5A shows the two-layer high-current half-turn winding 500 with terminals. FIG. 5B shows the cross connections 510 for the two-layer high-current half-turn winding 500. The two-layer half-turn winding 500 includes a first layer of winding 502 and a second layer of winding 520 electrically insulated from each other. Each of the first and second layers of windings 502 and 520 may be similar to the winding 300 of FIG. 3A. The first layer of winding 502 includes a plurality of half-turn coils connected in parallel between the terminals 515 and 516 and a plurality of half-turn coils connected in parallel between the high current terminals 517 and 518. The second layer of winding 520 includes a plurality of half-turn coils connected in parallel between the terminals 525 and 526 and a plurality of half-turn coils connected in parallel between the high current terminals 527 and 528. The cross connections 510 include a first connection 511 and a second connection 512. The first connection 511 electrically connects the terminals 517, 527, and 526 to the terminal 516. The second connection 512 electrically connects the terminal 515, 525, and 528 to the terminal 518. Thus, only the two terminals 516 are 518 would be used for connection to external circuits/devices. The two-layer half-turn winding 500 may be used as the high-current winding for the electric device 100 of FIG. 1 and the electric device 400 of FIG. 4.

Figure 6:
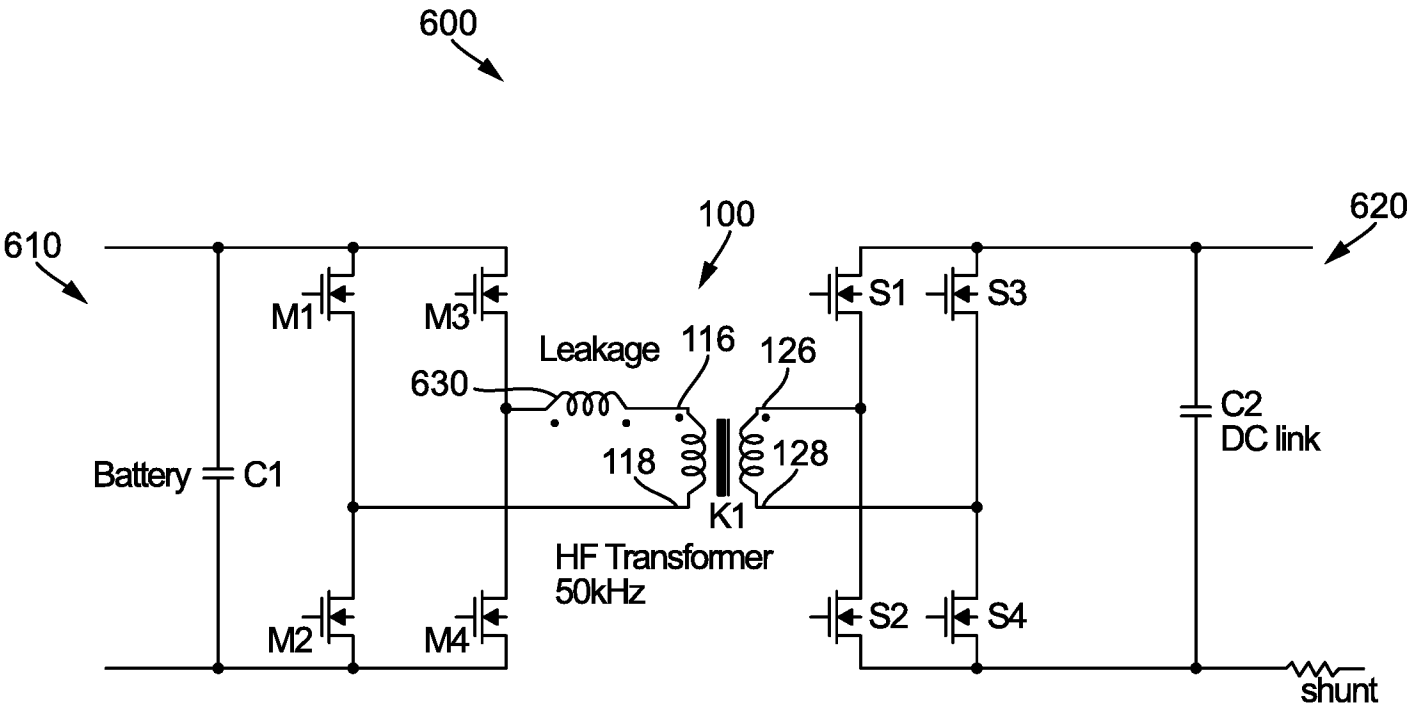
FIG. 6 is a schematic diagram of an electrical circuit of a DC-DC converter including the electric device used as a transformer according to an exemplary embodiment.

Referring to FIG. 6, a schematic diagram of an electrical circuit of a DC-DC converter platform 600 including the electric device 100 used as a transformer is shown according to an exemplary embodiment. The DC-DC converter 600 can be used in, for example, a battery charging circuit, transforming voltages between a first circuit 610 and a second circuit 620 through the electric device 100. The first circuit 610 is connected to the high current winding of the electric device 100 through the high current terminals 116 and 118. In some embodiments, the first circuit 610 includes a battery (e.g., 12 VDC, 24 VDC, 48 VDC, or 72 VDC) and inverter/rectifier for converting between a direct current (DC) and an alternating current (AC). The second circuit 620 is connected to the low current winding of the electric device 100 through the low-current-side terminals 126 and 128. In some embodiments, the second circuit includes a high-voltage DC bus (e.g., 200-800 VDC) and inverter/rectifier for converting between DC and AC.

The DC-DC converter 600 can step up or step down a voltage through the electric device 100. For example, during the engine electrification, the DC-DC converter 600 can step up the low voltage output from the battery of the first circuit 610 and provide the high voltage on the second circuit 620 to start the engine. When the engine is driving the alternator to generate electrical power, the DC-DC converter 600 can step down the generated high voltage from second circuit 620 and provide the low voltage for recharging the battery in the first circuit 610. In practice, some magnetic flux generated by the windings traverses paths outside the windings. The leakage flux results in leakage inductance which can be equalized as a leakage inductor 630 connected in series with a winding.

In the design of the electric device 100, the numbers of turns of the high current winding and the low current winding can be determined under given transformer specifications, such as frequency, power, high-current-side voltage and current, low-current-side voltage and current, etc. The number of turns of the high current winding satisfies the following equation.

$$N_{hc} = \frac{v_{lv}}{2 \cdot \pi \cdot f_s B_{max} A_c} \tag{1}$$

wherein $N_{hc}$ is the number of turns of the high current winding, $f_s$ is the frequency of the transformer, $V_{lv}$ is the high-current-side voltage, $B_{max}$ is the maximum flux density in the core, and $A_c$ is the cross-sectional area of the transformer core. The transformer core can be chosen using the area product method. In some embodiments, the high-current-side voltage $V_{lv}$ and the frequency of the transformer $f_s$ are fixed quantities. The maximum flux density $B_{max}$, the cross-sectional area of the transformer core $A_c$ can be subjected to change. In an example where $V_{lv}$=16 V, $f_s$=50 kHz, $B_{max}$=0.15 T, $A_c$=6.83 cm$^2$, the number of turns of the high-current winding $N_{hc}$ calculated by Equation (1) is 0.4974, approximately 0.5.

The half-turn design (i.e., $N_{hc}$~0.5) of the high-current-side winding is advantageous over a full-turn (i.e., $N_{hc}$~1). For a full-turn winding design of the above example where $V_{lv}$=16 V, fs=50 kHz ($V_{lv}$ and $f_s$ are fixed for an application), to achieve $N_{hc}$~1, $B_{max}$ and/or $A_c$ need to be reduced ($B_{max}$ and $A_c$ are subjected to change). However, reducing $B_{max}$ can implicate increasing the size of the transformer core for the same power and frequency, which means under-utilization of the core. Although reducing $A_c$ for the same core area product does not necessarily require increasing the size of the core, the design of customized cores can increase the manufacturing cost. In addition, customized cores might need further studies on the power density and heat dissipation when the surface area of the cores varies.

The number of turns of the low current winding can be determined by the following equation.

$$N_{lc}=n \cdot N_{hc} \tag{2}$$

wherein $N_{lc}$ is the number of turns of the low current winding, and n is the turns ratio, which can be given as a transformer specification. In the half-turn design of the high current winding where $N_{hc}$=½, if n=24, the number of turns of the low current winding $N_{lc}$ then is 12. For a full-turn design of the high current winding where $N_{hc}=1$, to satisfy the same turns ratio n=24, $N_{lc}$ calculated by Equation (2) would be 24, which is 12 more low-current turns than that in the half-turn design. As such, the total number of turns in both windings are reduced in the half-turn design; therefore the total winding resistance, total leakage inductance, winding material, transformer size, and cost can be reduced accordingly. It is noted that the ratio of this design can be altered after winding by changing the coupling of the high current half-turn coils via their external terminations. For example, the two half-turn coils in each layer can be series coupled by connecting their end terminals 315 and 317 before coupling the coils in parallel for an overall ration of 12. This also enables easy interleaving of the high-current coils, if desired. If external terminations are available for the full turn low current coils, they can be altered in a similar manner to alter the winding ratio, or kept internal to the winding structure to better enable cross connection or interleaving of the high-current coils.

Low leakage inductance can be achieved in transformers with half-turn high current windings. A two-winding transformer inductance matrix is:

$$\begin{bmatrix} M_{11} & M_{12} \\ M_{21} & M_{22} \end{bmatrix} \tag{3}$$

Diagonal elements of the inductance matrix (e.g., $M_{11}$ and $M_{22}$) represent self-inductance of each current loop (e.g., the high current winding and the low current winding). Self-inductance is numerically equal to the flux linkage in one current loop with a current of one ampere (1 A) flowing through when no current is flowing in the other loop. For example, $M_{11}$ is numerically equal to the flux in the high current winding when a current of 1 A is flowing in the high current winding and no current is flowing in the low current winding. Off-diagonal elements of the inductance matrix (e.g., $M_{12}$ and $M_{21}$) represent the mutual inductance between the current loops. A mutual inductance is numerically equal to the flux linkage in a current loop when a current of 1 A is flowing through the other loop, and no current is flowing anywhere else. For example, $M_{12}$ is numerically equal to the flux linkage in the high current winding when a current of 1 A is flowing through the low current winding and no current is flowing in the high current winding.

For the inductance matrix with elements $M_{ij}$, j=1, . . . , N, a coupling coefficient for the i-th row i and the j-th column is defined as:

$$k = \frac{|M_{ij}|}{\sqrt{M_{ii} \times M_{jj}}} \tag{4}$$

The coupling coefficient k indicates how much flux in the i-th winding is linked with the j-th winding. If all the flux in the i-th winding reaches the j-th winding, then k=1, meaning the coupling is 100%. Inductors with k>0.5 are tightly coupled; inductors with k<0.5 are loosely coupled. The leakage inductance of a two-winding transformer is calculated as below.

$$L_{lk1}=M_{11}(1-k) \tag{5}$$

$$L_{lk2}=M_{22}(1-k)/n^2 \tag{6}$$

$$\text{Total } L_{leakage}=L_{lk1}+L_{lk2} \tag{7}$$

A computer aided model based on practically available winding conductors and cores was developed using Ansys Maxwell 3D finite-element electromagnetic tool. The leakage inductance was obtained for the above example where $V_{lv}=16$ V, $f_s=50$ kHz, $N_{hc}=½$, and high-current to low-current turns ratio n=1:24. From the computer aided simulation, the total leakage inductance is:

$$\text{Total } L_{leakage}=L_{lk1}L_{lk2}=55.1 \text{ nH} \tag{8}$$

Thus, a low leakage inductance was achieved on the half-turn high-current winding design with reduced total number of turns in both windings, under this exemplary computer-aided model.

The half-turn high current winding and the full-turn low current winding may be constructed from foil winding, solid wire, stranded wire, or Litz wire. In stranded wire, multiple smaller conductor strands are bundled into a single larger conductor which has a high combined surface area for a given cross section. Thus, skin effect may be mitigated when stranded wire is used. In Litz wire, a plurality of thin wire strands, individually insulated and twisted or woven together, and commonly terminated. Thus, the parasitic capacitance may be further reduced if Litz wire is used.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," etc.) are merely used to describe the orientation of various elements in the FIGURES. It should be noted that the orientation of various elements may differ according to other example embodiments, and that such variations are intended to be encompassed by the present disclosure.

It is important to note that the construction and arrangement of the various example embodiments are illustrative only. Although only a few embodiments have been described in detail in this disclosure, those skilled in the art who review this disclosure will readily appreciate that, unless specifically noted, many modifications are possible (e.g., variations in sizes, structures, shapes and proportions of the various elements, values of parameters, mounting arrangements, use of materials, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. Unless specifically noted, the order or sequence of any process or method steps may be varied or re-sequenced according to alternative embodiments. Other substitutions, modifications, changes and omissions may also be made in the design, operating conditions and arrangement of the various example embodiments without departing from the scope of the present invention.

What is claimed is:

1. An electric device, comprising:

a core comprising a center section and two outer sections;

a high current winding including a plurality of half-turn coils connected in parallel between a first high current terminal and a second high current terminal, each of the plurality of half-turn coils wound around a fraction of the center section of the core, wherein each of the plurality of half-turn coils forms a loop around one of the two outer sections along with the first high current terminal and the second high current terminal; and a low current winding including a plurality of full-turn coils connected in series between a first low current terminal and a second low current terminal, each of the plurality of full-turn coils wound around the center section of the core substantially fully;

wherein the plurality of half-turn coils of the high current winding are interleaved with the plurality of full-turn coils of the low current winding, and wherein the plurality of half-turn coils includes a first set of half-turn coils connected in parallel with a second set of half-turn coils between the first high current terminal and the second high current terminal, wherein each of the first set of half-turn coils is wound around a first half of the center section of the core, and wherein each of the second set of half-turn coils is wound around a second half of the center section of the core.

2. The electric device of claim 1, wherein the electric device is a transformer.

3. The electric device of claim 1, wherein the core includes a ferrite core or a low permeability core.

4. The electric device of claim 1, wherein the high current winding further comprises:

a first cross connection electrically connecting a first end of the first set of half-turn coils to a first end of the second set of half-turn coils; and a second cross connection electrically connecting a second end of the first set of half-turn coils to a second end of the second set of half-turn coils.

5. The electric device of claim 1, wherein the plurality of half-turn coils or the plurality of full-turn coils are constructed from foil winding, solid wire, stranded wire, or Litz wire.

6. The electric device of claim 1, wherein the high current winding is interleaved with the low current winding, and wherein the plurality of full-turn coils of the low current winding are internally terminated.

7. The electric device of claim 6, wherein the plurality of half-turn coils of the high current winding provide openings for continuous wrapping of the plurality of full-turn coils of the low current winding.

8. The electric device of claim 1, wherein the center section carries total magnetic flux flowing through the core, and wherein the two outer sections each carry half of the total magnetic flux.

9. The electric device of claim 1, wherein the high current winding includes a first layer of high current winding and a second layer of high current winding electrically insulated from each other, wherein each of the first layer of high current winding and the second layer of high current winding includes a plurality of half-turn coils connected in parallel between the first high current terminal and the second high current terminal.

10. The electric device of claim 1, wherein the high current winding includes more than one layers of high current winding electrically insulated from each other, wherein each layer of high current winding includes a plurality of half-turn coils connected in parallel between the first high current terminal and the second high current terminal.

11. An electric device, comprising:

a core comprising a center section and two outer sections; and a winding including a plurality of half-turn coils connected in parallel between a first terminal and a second terminal, each of the plurality of half-turn coils wound around a fraction of the center section of the core;

wherein each of the plurality of half-turn coils forms a loop around one of the two outer sections along with the first terminal and the second terminal, and wherein the plurality of half-turn coils includes a first set of half-turn coils connected in parallel with a second set of half-turn coils between the first terminal and the second terminal, wherein each of the first set of half-turn coils is wound around a first half of the center section of the core, and wherein each of the second set of half-turn coils is wound around a second half of the center section of the core.

12. The electric device of claim 11, wherein the electric device is an inductor.

13. The electric device of claim 11, wherein the core includes a ferrite core or a low permeability core.

14. The electric device of claim 11, wherein the high current winding further comprises:

a first cross connection electrically connecting a first end of the first set of half-turn coils to a first end of the second set of half-turn coils; and a second cross connection electrically connecting a second the other end of the first set of half-turn coils to a second end of the second set of half-turn coils.

15. The electric device of claim 11, wherein the plurality of half-turn coils are constructed from foil winding, solid wire, stranded wire, or Litz wire.

16. The electric device of claim 11, wherein the center section carries total magnetic flux flowing through the core, and wherein the two outer sections each carry half of the total magnetic flux.

17. The electric device of claim 11, wherein the winding includes a first layer of winding and a second layer of winding electrically insulated from each other, wherein each of the first layer of winding and the second layer of winding includes a plurality of half-turn coils connected in parallel between the first terminal and the second terminal.

18. The electric device of claim 11, wherein the winding includes more than one layers of winding electrically insulated from each other, wherein each layer of winding includes a plurality of half-turn coils connected in parallel between the first terminal and the second terminal.

* * * * *